US005147976A

United States Patent [19]

Laurensou et al.

[11] Patent Number: 5,147,976

[45] Date of Patent: Sep. 15, 1992

[54] IGNITION SYSTEM FOR A PYROTECHNIC COMPOSITION

[75] Inventors: René L. Laurensou; Richard Vinau, both of Bourges, France

[73] Assignee: Giat Industries, France

[21] Appl. No.: 729,542

[22] Filed: Jul. 15, 1991

[30] Foreign Application Priority Data

Jul. 27, 1990 [FR] France ..... 90 09604

[51] Int. Cl.[5] ..... F42D 1/04; C06C 9/00; F42B 3/11; F42C 19/08

[52] U.S. Cl. ..... 102/275.3; 102/275.11

[58] Field of Search ..... 102/275.3, 275.1, 275.4, 102/275.6, 275.8, 275.9, 275.11

[56] References Cited

U.S. PATENT DOCUMENTS

| | | | |
|---|---|---|---|
| 2,730,046 | 1/1956 | Bergström et al. | 102/229 |
| 2,796,834 | 6/1957 | McCaffrey et al. | 102/275.3 |
| 3,343,487 | 9/1967 | Hare et al. | 102/275.3 |
| 3,727,552 | 4/1973 | Zakheim | 102/275.3 |
| 4,841,856 | 6/1989 | Gisler et al. | 102/275.3 |

*Primary Examiner*—David H. Brown

*Attorney, Agent, or Firm*—Parkhurst, Wendel & Rossi

[57] ABSTRACT

The ignition system according to the invention comprises an ignition relay (4), placed in a housing (3), and which is in contact with the pyrotechnic composition (2). It is characterized in that the housing (3) is closed by a lattice (5) in contact with a flame-sensitive composition (6), itself in contact with the ignition relay (4).

10 Claims, 1 Drawing Sheet

IGNITION SYSTEM FOR A PYROTECHNIC COMPOSITION

BACKGROUND OF THE INVENTION

This invention concerns the field of ignition systems for pyrotechnic compositions, and in particular for delayed action pyrotechnic compositions.

These compositions are generally ignited by means of a so-called hot composition (such as a mixture of titanium and boron), itself initiated by a composition sensitive to percussion or to the heating of an electrical conductor.

The compositions are enclosed in a housing whose function is to isolate them from the ambient humidity that deteriorates their properties.

Thus, for initiation by percussion, the housing is closed by a metal sheet (foil) (usually of aluminum or tin) which is sufficiently thin to be perforated by a striker (see for example U.S. Pat. No. 4,841,856).

In order to install such a delayed action system in a non-electrical detonator for a projectile or military explosive charge, it is indispensable to position the ignition system opposite a striker, so that the position at the end of the delayed action period is opposite the pyrotechnic chain to be actuated.

The form of the delayed action component thus depends on the final structure of the detonator, which implies that any change in the design of the system entails the redesign of the delayed action component.

For detonators for rocket projectiles, provision has already been made to separate the percussion detector from a receiving pyrotechnic composition by a pipe. Refer in particular to U.S. Pat. No. 2,730,046 and French Patent No. 2533687.

However, the receiving composition is always another detonator which is initiated by the impact resulting from the projection of metallic fragments, this impact being perfectly capable of initiating the detonation through the foil.

In fact, the hot compositions required to ignite delayed action pyrotechnic compositions are not sufficiently sensitive to impact to be able to be initiated directly in this way, and it is therefore necessary to provide an additional detonator upstream from the hot composition, a detonator that is initiated directly by a striking pin (with the problems of definition of the geometry of the delayed action discussed above), or by means of a pipe.

In all cases, the impact sensitivity of the ignition system is enhanced. If a pipe is used, it must be rectilinear to avoid decreasing the energy of the projected particles.

The object of the invention is to overcome these drawbacks by proposing an ignition system that is insensitive to impact, and which can be initiated remotely by means of an igniter.

SUMMARY OF THE INVENTION

The invention thus provides an ignition system for a pyrotechnic composition comprising, placed in a housing, an ignition relay which is in contact with the pyrotechnic composition, characterized in that the housing is closed by a netting in contact with a flame-sensitive composition, which is itself in contact with the ignition relay.

Thus the mechanical properties of the composition are guaranteed, and ignition is possible through the netting.

The mesh size of the netting should preferably be smaller than the grain size distribution of the flame-sensitive composition, making it possible to use a noncompacted composition.

The flame-sensitive composition includes a mixture containing 25 to 50% by weight of zirconium and 50 to 75% by weight of barium chromate, and is preferably a compact containing 37% by weight of zirconium and 63% by weight of barium chromate, with the grain size distribution of the mixture ranging between 40 and 100 μm.

According to other features, the ignition relay comprises a mixture consisting of 20 to 60% by weight of zirconium, 30 to 70% by weight of barium chromate, and 0 to 20% by weight of potassium perchlorate, and the relay is preferably a compact containing 40% by weight of zirconium, 50% by weight of barium chromate, and 10% by weight of potassium perchlorate.

The ignition system can advantageously be applied to the preparation of a delayed action fuse incorporated in a metal sleeve.

The ignition system is employed in a detonator in which the detonating composition sensitive to percussion is connected to the flame-sensitive composition by a pipe.

The detonator composition sensitive to percussion should preferably comprise a compact of a mixture of 52% by weight of potassium perchlorate, 25% by weight of lead thiocyanate, 13% by weight of antimony sulfide, and 10% by weight of lead tricinate.

The invention can be better understood on the reading of the description of a specific embodiment, a description made by reference to the appended drawings in which:

DESCRIPTION OF THE PREFERRED EMBODIMENTS

Figure 1:
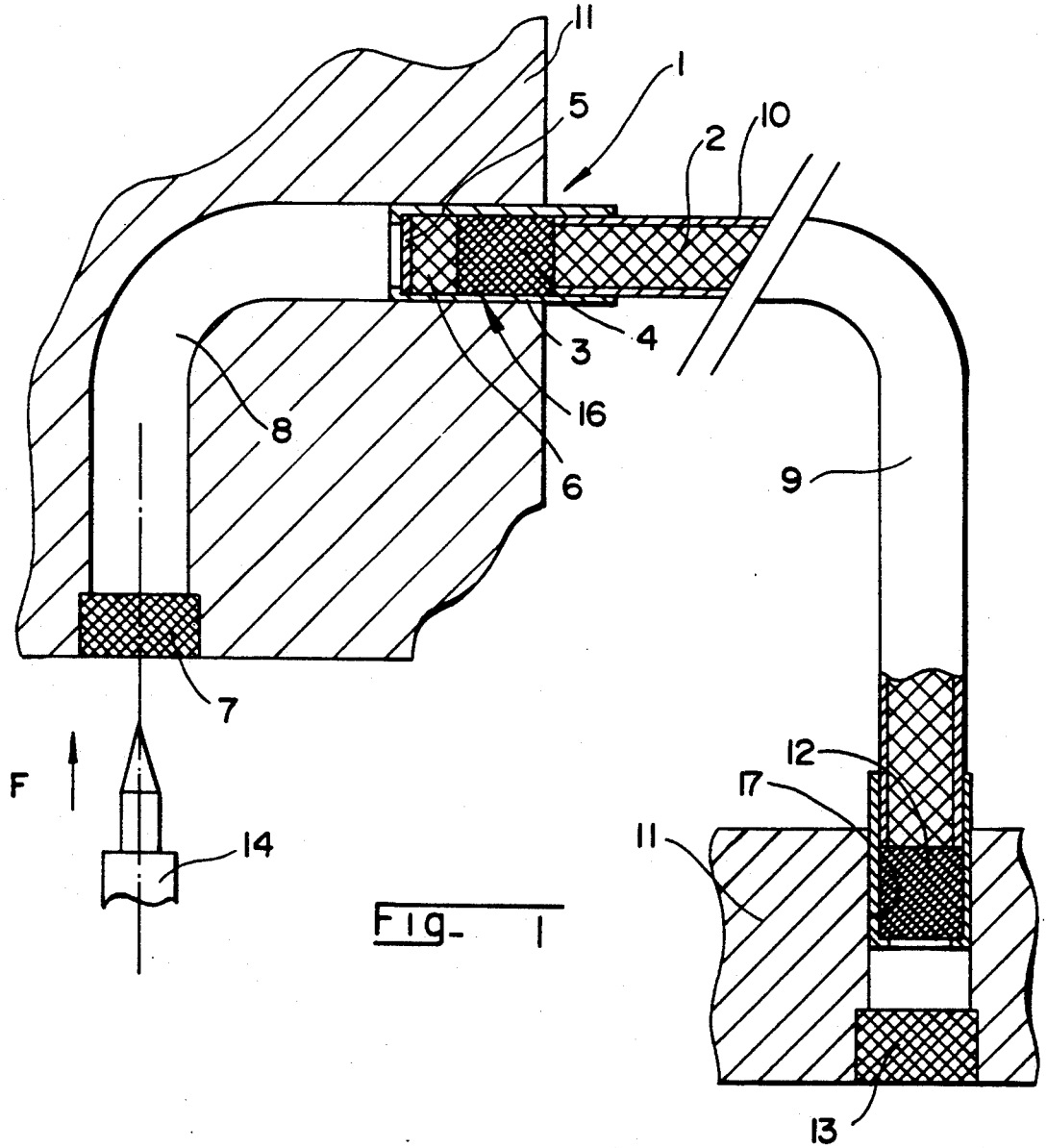
FIG. 1 shows an ignition system according to the invention associated with a pyrotechnic delayed action fuse and to a detonator shown schematically.

By referring to FIG. 1, an ignition system 1 according to the invention is shown integral with a fuse 9 containing a delayed action pyrotechnic composition 2. It is composed of a housing 3 of aluminum alloy, of which the thickness if a few tenths of an mm, and which is fixed to the fuse 9 by latches.

Inside the housing is placed an ignition relay 4 which is here a mixture of 40% by weight of tungsten (W), 50% by weight of barium chromate ($BaCrO_4$), and 10% by weight of potassium perchlorate ($KClO_4$), the grain size distribution of the components being preferably less than 100 μm.

The above weight proportions may vary within the following ranges:

tungsten between 20 and 60%, barium chromate between 30 and 70%, and potassium perchlorate between 0 and 20%.

Any other hot composition containing an oxidizing agent and a reducing agent can be considered, such as a mixture of aluminum an copper oxide AlCuO in respective weight proportions of 20/80%, or a mixture of zirconium and lead chromate in respective weight proportions of 60/40%, or a mixture of boron and potassium nitrate in respective weight proportions of 60/40%.

An inter-metallic composition could also be used, such as titanium/boron (TiB). The choice of the properties of this hot composition of the ignition relay 4 essentially depends on the type of delayed action pyrotechnic composition to be ignited.

The foregoing example ($W/BaCrO_4/KClO_4$) is ideal for the pyrotechnic delayed action which is described below.

Placed in contact with the ignition relay is a flame-sensitive composition 6, which is here a mixture of zirconium and barium chromate in respective weight proportions of 37/63%, with a grain size distribution between 50 and 100 μm.

The weight proportions may vary within the following ranges:

zirconium between 25 and 50%, and barium chromate between 50 and 75%.

Any other composition containing an oxidizing agent and a reducing agent could be adapted, for example a composition of magnesium, Teflon (registered trademark of polytetrafluoroethylene) or Viton (registered trademark for a copolymer of vinylidene fluoride/hexafluoropropylene), but the criterion for selecting the composition is its flame sensitivity.

This property is determined, for example, by means of the test standardized by "Groupment Francais d'Etude des Modes Opératoires (GEMO)" under Reference FA505A1.

This test is as follows:

a column is used to adjust the distance between a reference igniter and a test composition, the reference igniter contains 0.034 g of a composition which is a mixture in weight proportions of 15% calcium silicide, 17% antimony sulfide, 30% barium nitrate, 35% lead styphnate, and 3% tetrazene, the mixture being compressed to $10^8$ Pa, the igniter is initiated by percussion by crushing, the test composition is placed in bulk in a dish.

The given composition is considered as sensitive to flame if, in ten consecutive tests, it exhibits 100% initiation by the igniter thus described at a distance of at least 470 mm.

The sensitivity can be adjusted by adjusting the compression ratio of the composition. A composition is more sensitive if it is less compressed, and a compression ratio between $10^7$ and $8 \cdot 10^7$ Pa is preferable.

The composition of the ignition relay 4 and that of the flame-sensitive composition 6 are prepared by known processes, such as the one comprising the following phases: coating by a binder (for example nitrocellulose) in a solvent, drying, granulation, placement in the housing and compression.

A metal lattice 5 is placed on the composition 6, and the housing 3 is closed on the whole by annular crimping.

Figure 2:
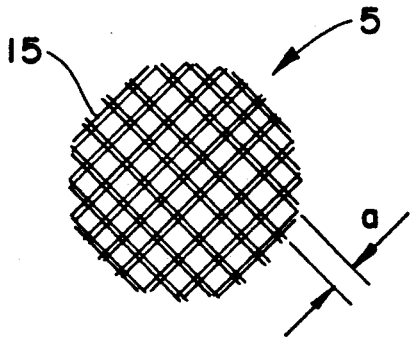
FIG. 2 shows the lattice only.

The lattice is shown in detail in FIG. 2. It has intersecting stainless steel wires 15 about one hundredth of an mm in diameter. The mesh size of the lattice (a), which is defined as the diameter of the largest particle passing through the lattice, is smaller than the grain size distribution of the mixture, and is a mesh size of 40 μm here.

The advantage of this arrangement is to permit direct contact between a flame and the composition 6 through the meshes of the lattice, without harming the mechanical behavior of the component, which could even be non-compacted.

The lattice material is selected in accordance with the mechanical strength desired. Metallic materials, particularly stainless steel, can be used to obtain fine mesh lattices with adequate rigidity.

As a comparison, an identical composition, enclosed in an identical housing closed by an aluminum 'foil' 0.03 mm thick, is not ignited by the flame.

This is because, by allowing the dissipation of the heat received, the thermal conductivity of the 'paillet' prevents any ignition.

In the embodiment described here, the housing 3 is adjusted freely in a bore 16 made in a detonator 11 (not shown in detail).

This is another advantage offered by the invention.

Thus it is not indispensable to ensure confinement, because the mesh size of the lattice guarantees suitable ignition of the composition, even in the case of gas flows at the periphery of the housing 3.

A pipe 8 connects the flame-sensitive composition 6 to a detonating composition 7 sensitive to percussion and which can be associated with a flame-reinforcing composition, the combination forming an igniter.

It is possible, for example, to use as a detonating composition a compact of the mixture of potassium perchlorate, lead thiocyanate, antimony sulfide and lead tricinate in the respective weight proportions of 52±20%, 25±10%, 13±10% and 10±10%.

And, as a flame-reinforcing compositions, a mixture of zirconium and lead chromate in the respective weight proportions of 60±10% and 40±10%.

Generally, and in a known manner, the detonating composition can include an oxidizing agent (such as potassium perchlorate), a reducing agent (such as lead thiocyanate), an agent increasing friction (such as antimony sulfide), and, if necessary, a sensitizer (such as lead tricinate), the flame-reinforcing composition being an oxidizing/reducing composition.

The igniter and the pipe are thus associated with the detonating system described above to complete the pyrotechnic ignition chain of the delayed action composition 2 of fuse 9.

The detonation composition 7 is initiated by a striker 14 which moves toward it in direction F.

It can be seen that due to the ignition system according to the invention, it is possible to separate the delayed action composition from the percussion mechanism.

It is thus possible with the igniter described above, associated with the flame-sensitive composition zirconium 37%/barium chromate 63%, to place a pipe with a developed length of about 20 mm between the igniter and the lattice.

The pipe can exhibit various shapes and profiles, since the lattice does not isolate the flame-sensitive composition from the projections issuing from the igniter.

As already observed in the preamble, in the known devices containing pipes, the receiving composition is a percussion-sensitive composition, and the pipe is rectilinear so as to avoid slowing down the flow of the hot particles which impact the receiving composition.

With the invention, it is possible to define pipes that are not rectilinear, the only important parameter being the length of the pipe.

The length of the pipe is usually imposed by the design of the detonator.

The ignition system is accordingly designed by adjusting the power of the igniter 7 (for example by increasing its weight) and/or the sensitivity of the flame-sensitive composition 6 (for example, by changing the compression ratio).

The delayed action fuse 9, of a known type, comprises for example a composition 2 of tungsten, barium chromate and potassium perchlorate in respective weight proportions of 30, 60 and 10% (see for example French Patent No. 2464932). This composition 2 is enclosed in a metal sleeve 10, of lead or tin, with about 3 mm outside diameter.

The outer end of this fuse is placed in a bore 17 provided in the detonator 11. It carries a detonation relay 12 of a known type, for example consisting of a layer of lead azide with a layer of Hexogen.

This relay initiates a receiving charge 13 which in turn initiates an explosive charge not shown.

It is clearly possible to adapt the ignition system according to the invention to an electrical initiation mode by replacing the percussion igniter 7 by an electrically-initiated igniter (hot wire or exploded wire), the other components of the ignition system remaining unchanged.

It is also possible to adapt the ignition system according to the invention to the ignition of a pyrotechnic composition other than the delayed action compositions, for example to a gas-generating composition.

We claim:

1. The ingnition system (1) for a pyrotechnic composition comprising, placed in a housing (3), an ignition relay (4) which is in contact with the pyrotechnic composition (2), characterized in that the housing (3) is closed by a lattice (5) in contact with a flame-sensitive composition (6) itself in contact with the ignition relay (4).

2. Detonator according to claim 1, characterized in that the detonating composition sensitive to percussion (7) comprises a compact of a mixture of 52% by weight of potassium perchlorate, 25% by weight of lead thiocyanate, 13% by weight of antimony sulfide, and 10% by weight of lead tricinate.

3. The ignition system of claim 1, wherein said pyrotechnic composition (2) is at least partially disposed in a metal sleeve (10), thereby defining a fuse (9).

4. The ignition system of claim 1, further comprising a detonating composition (7) connected to said flame sensitive composition (6) by a pipe (8), wherein said detonating composition (7) is percussion sensitive.

5. Ignition system according to claim 1, characterized in that the fineness (a) of the meshes of the lattice (5) is finer than the grain size distribution of the flame-sensitive composition (6).

6. Ignition system according to claim 5, characterized in that the flame-sensitive composition (6) includes a mixture consisting of 25 to 50% by weight of zirconium, and 50 to 75% by weight of barium chromate.

7. Ignition system according to claim 6, characterized in that the flame-sensitive composition (6) is a compact containing 37% by weight of zirconium and 63% by weight of barium chromate.

8. Ignition system according to claim 7, characterized in that the grain size distribution of the flame-sensitive composition (6) ranges between 50 and 100 μm.

9. Ignition system according to claims 6, characterized in that the ignition relay (4) contains a mixture consisting of 20 to 60% by weight of zirconium, 30 to 70% by weight of barium chromate, and 0 to 20% by weight of potassium perchlorate.

10. Ignition system according to claim 9, characterized in that the ignition relay (4) is a compact containing 40% by weight of zirconium, 50% by weight of barium chromate, and 10% by weight of potassium perchlorate.

* * * * *